US007182572B2

(12) United States Patent
Yang

(10) Patent No.: US 7,182,572 B2
(45) Date of Patent: Feb. 27, 2007

(54) IMPELLER ASSEMBLY

(76) Inventor: Sheng-An Yang, No. 373, Jwuliao Rd., Dashu Hsiang, Kaohsiung Hsien (TW)

( * ) Notice: Subject to any disclaimer, the term of this patent is extended or adjusted under 35 U.S.C. 154(b) by 85 days.

(21) Appl. No.: 10/939,539

(22) Filed: Sep. 13, 2004

(65) Prior Publication Data

US 2005/0063825 A1 Mar. 24, 2005

(30) Foreign Application Priority Data

Sep. 22, 2003 (TW) ..... 92126067 A
Oct. 7, 2003 (TW) ..... 92127771 A

(51) Int. Cl.
*F04D 29/34* (2006.01)
*F04D 29/38* (2006.01)

(52) U.S. Cl. ..... 415/175; 415/183; 415/203

(58) Field of Classification Search ..... 416/175, 416/183, 203, 212 R
See application file for complete search history.

(56) References Cited

U.S. PATENT DOCUMENTS 809,277 A * 1/1906 Barker ..... 416/248
5,611,668 A * 3/1997 Yapp et al. ..... 416/189
6,318,964 B1 * 11/2001 Yang ..... 416/185
6,511,300 B2 * 1/2003 Otsuka ..... 417/354
6,572,336 B2 * 6/2003 Horng et al. ..... 416/183
6,779,992 B2 * 8/2004 Lei et al. ..... 416/198 R
2004/0219022 A1 * 11/2004 Yang ..... 416/186 R

FOREIGN PATENT DOCUMENTS

JP 2003163481 A * 6/2003

* cited by examiner

*Primary Examiner*—Igor Kershteyn
(74) *Attorney, Agent, or Firm*—Alan D. Kamrath; Nikolai & Mersereau, P.A.

(57) ABSTRACT

An impeller assembly has a hollow body, multiple main blades and multiple booster blades. The main blades are mounted around the body to define multiple flow channels between the main blades. The boosting blades are mounted around the body at the bottom edge and each is located at one of the flow channels. Each booster blade has a segment aligning with and overlapping a corresponding one of the main blades. In such an arrangement, the speed of airflow is increased and the heat-dissipating efficiency provided by the impeller assembly is enhanced.

10 Claims, 10 Drawing Sheets

IMPELLER ASSEMBLY

BACKGROUND OF THE INVENTION

1. Field of the Invention

The present invention relates to an impeller assembly and, more particularly, to an impeller assembly with multiple booster blades each mounted between adjacent main blades to increase the speed of airflow and to enhance heat-dissipating efficiency.

2. Description of Related Art

With reference to FIG. 10, a heat-dissipating impeller (50) in accordance with the prior art comprises a body (51) and multiple blades (52). The blades (52) are mounted around the body (51) to define multiple flow channels (53) between the blades (52). When the impeller (50) is driven to rotate, air will be sucked into the flow channels (53) from the tops of the channels (53) and is exhausted from the bottoms of the channels (53). Consequently, heat generated by an electrical member is dissipated with the airflow generated by the impeller (50) so as to reduce operational temperature of the electrical member.

However, air turbulence easily generates in the flow channels (53) at the bottom edge of the body (51), such that the speed of the airflow exhausting out of the flow channels (53) of the conventional impeller (50) is reduced. Consequently, the dissipating effect to the heat generated by the corresponding electrical member is reduced.

To overcome the shortcomings, the present invention tends to provide an impeller assembly to mitigate or obviate the aforementioned problems.

SUMMARY OF THE INVENTION

The main objective of the invention is to provide an impeller assembly having multiple booster blades to increase the speed of airflow and to enhance heat-dissipating efficiency. The impeller assembly has a hollow body, multiple main blades and multiple booster blades. The main blades are mounted around the body to define multiple flow channels between the main blades. The boosting blades are mounted around the body at the bottom edge and each is located at one of the flow channels. Each booster blade has a segment aligning with and overlapping a corresponding one of the main blades.

Other objectives, advantages and novel features of the invention will become more apparent from the following detailed description when taken in conjunction with the accompanying drawings.

DETAILED DESCRIPTION OF PREFERRED EMBODIMENT

Figure 1:
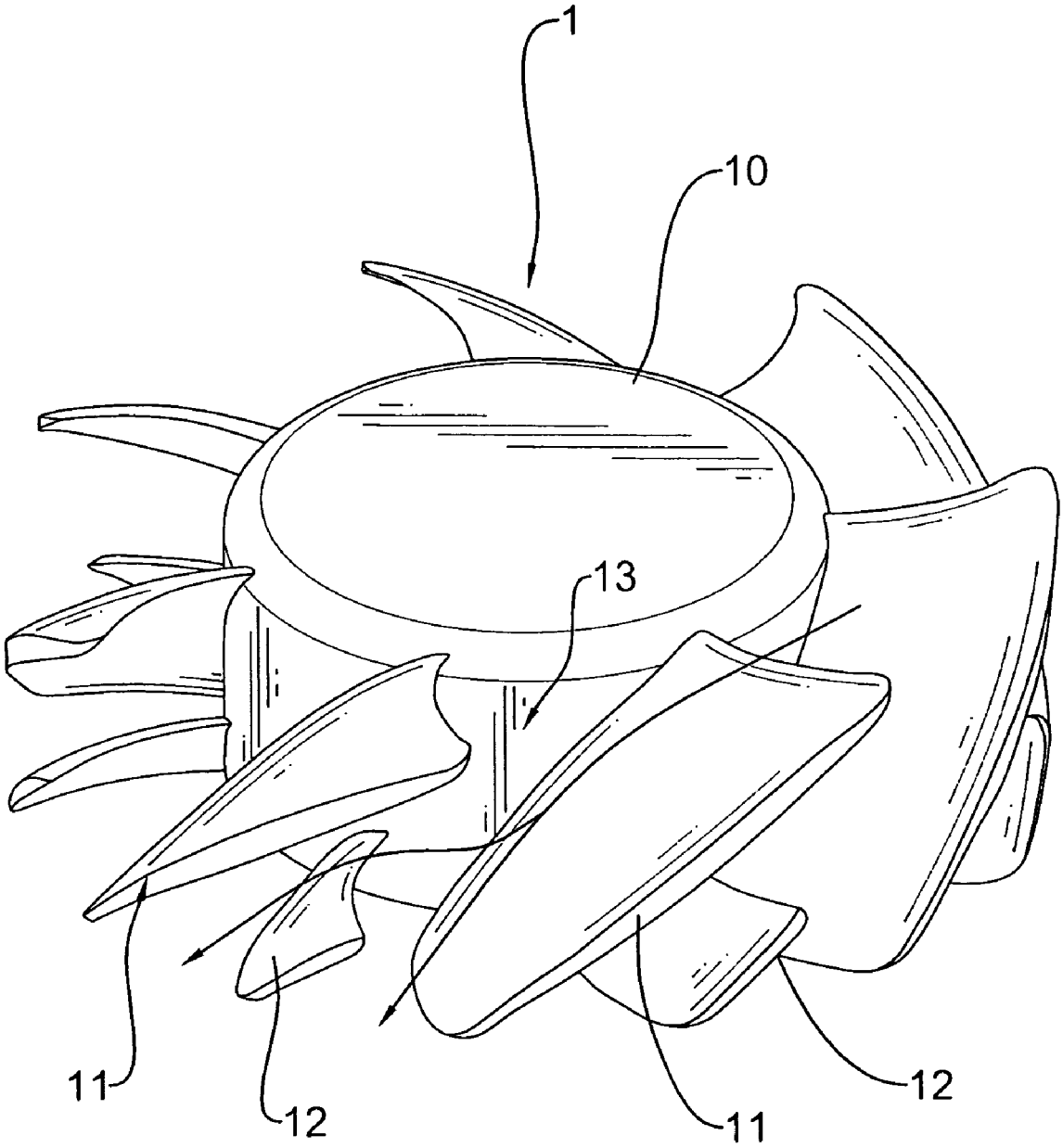
FIG. 1 is a perspective view of a first embodiment of an impeller assembly in accordance with the present invention.

With reference to FIG. 1, an impeller assembly (1) in accordance with the present invention comprises a body (10), multiple main blades (11) and multiple booster blades (12). The body (10) is hollow and has a bottom edge. The main blades (11) are mounted around the body (10) to define multiple flow channels (13) between the main blades (11). Each flow channel (13) has an inlet at the top of the body (10) and an outlet at the bottom of the body (10). The booster blades (12) are mounted around the body (10) at the bottom edge and each is located at one of the flow channels (13). Each booster blade (12) has a segment aligning with and overlapping with a corresponding one of the main blades (11).

With the arrangement of the booster blades (12), the outlets of the flow channels (13) will be divided into two parts and narrowed. Accordingly, the speed of the air flowing out of the flow channels (13) is increased. In addition, the booster blades (12) can provide an auxiliary attraction to the airflow in the flow channels (13), and this can keep air turbulence from generating in the flow channels (13). Consequently, the heat dissipating effect provided by the impeller assembly (1) to a corresponding electrical member is improved. Furthermore, the air exhausting from the outlets of the flow channels (13) can be prevented from flowing back to the flow channels (13) by the booster blades (12), such that the temperature of air in the flowing channels (13) will not increase during the operation of the impeller assembly (1). This can further improve the heat-dissipating efficiency of the impeller assembly (1).

Figure 2:
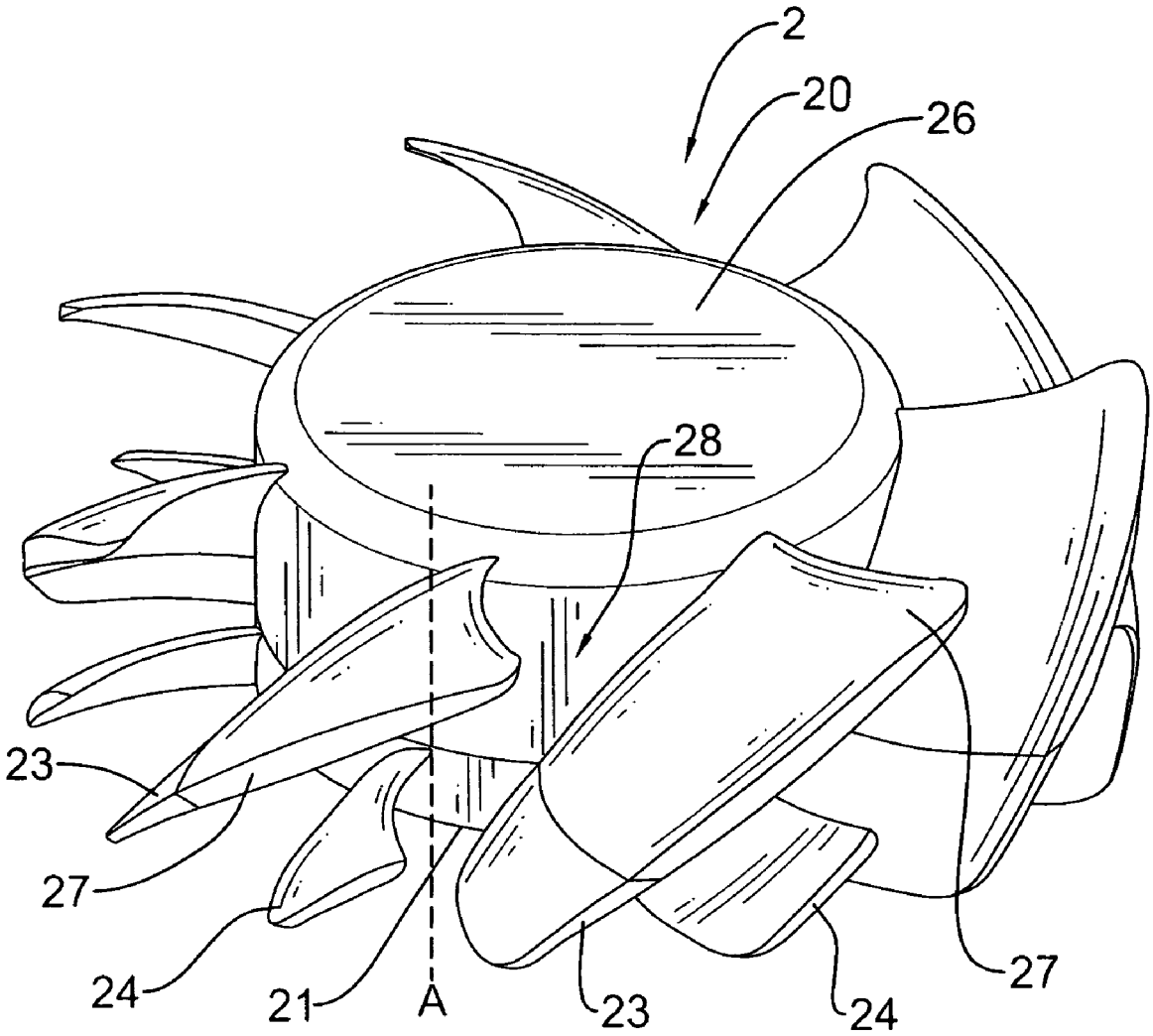
FIG. 2 is a perspective view of a second embodiment of an impeller assembly in accordance with the present invention.
Figure 3:
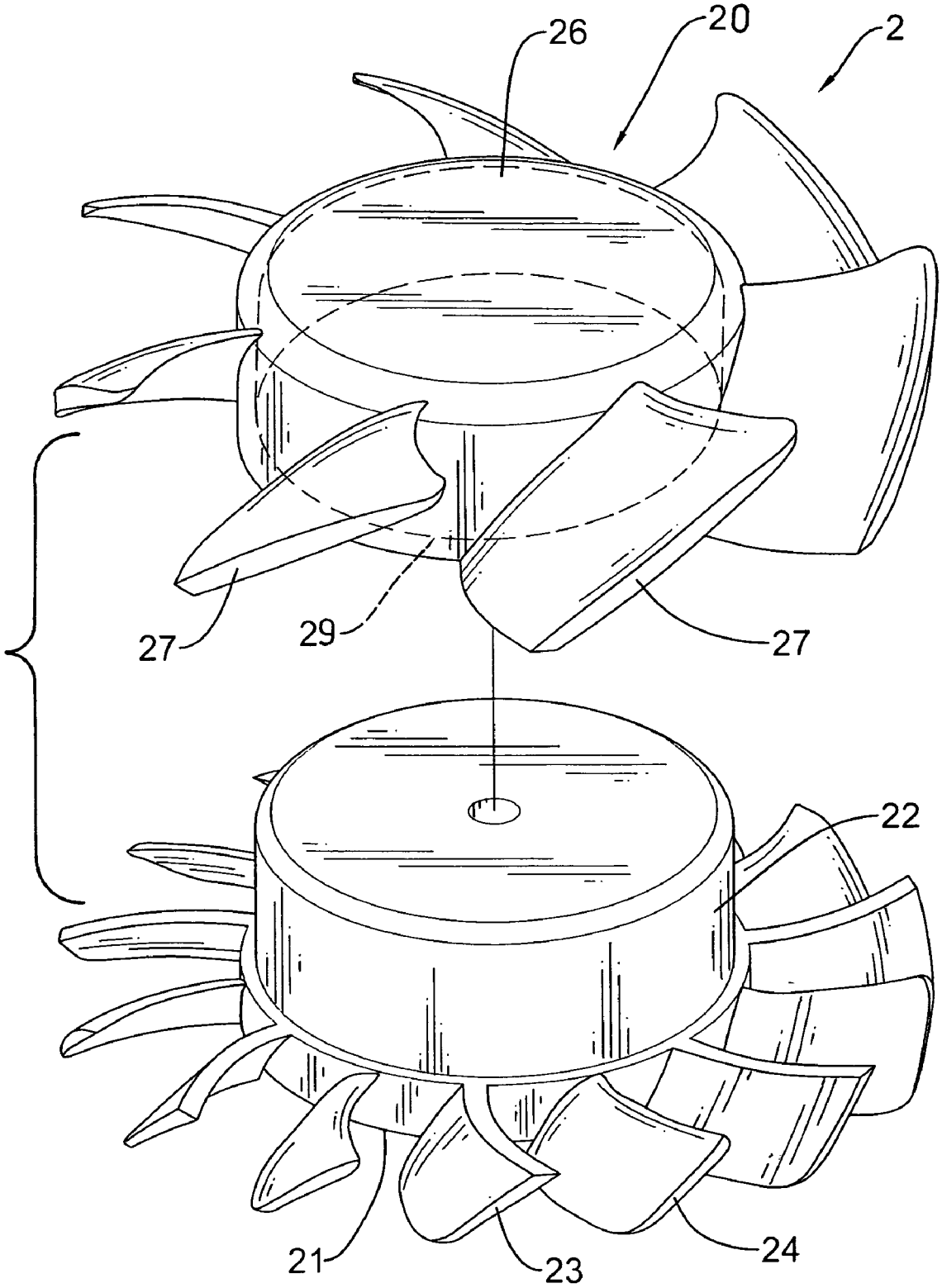
FIG. 3 is an exploded perspective view of the second embodiment of the impeller assembly in FIG. 2.

With reference to FIGS. 2 and 3, in a second embodiment of an impeller assembly (2), the body (20) is composed of an upper hub (26) and a lower hub (21) attached to the upper hub (26). The lower hub (21) has a top and a protrusion (22) formed on the top. The upper hub (26) has a bottom cavity (29) mounted around the protrusion (22) on the lower hub (21) to combine the upper hub (26) with the lower hub (21). In a preferred embodiment, the protrusion (22) has a diameter smaller than that of the lower hub (21), and the bottom cavity (29) has a diameter equal to that of the protrusion (22) on the lower hub (21). Accordingly, the upper hub (26) is securely combined with the lower hub (21) with the engagement of the protrusion (22) and the bottom cavity (29).

The lower hub (21) and the upper hub (26), respectively, have multiple blade elements (23,27) to form the main blades with the blade elements (23,27) on the hubs (21,26). Flow channels (28) are defined between the combined main blades. The booster blades (24) are formed on the lower hub (21) and each is located between adjacent blade elements (23) on the lower hub (21). In the second embodiment, a line A extending upward from the top edge of a booster blade (24) is pointed to a part of the corresponding main blade, meaning that the booster blade (24) entirely overlaps with the corresponding main blade.

Figure 4:
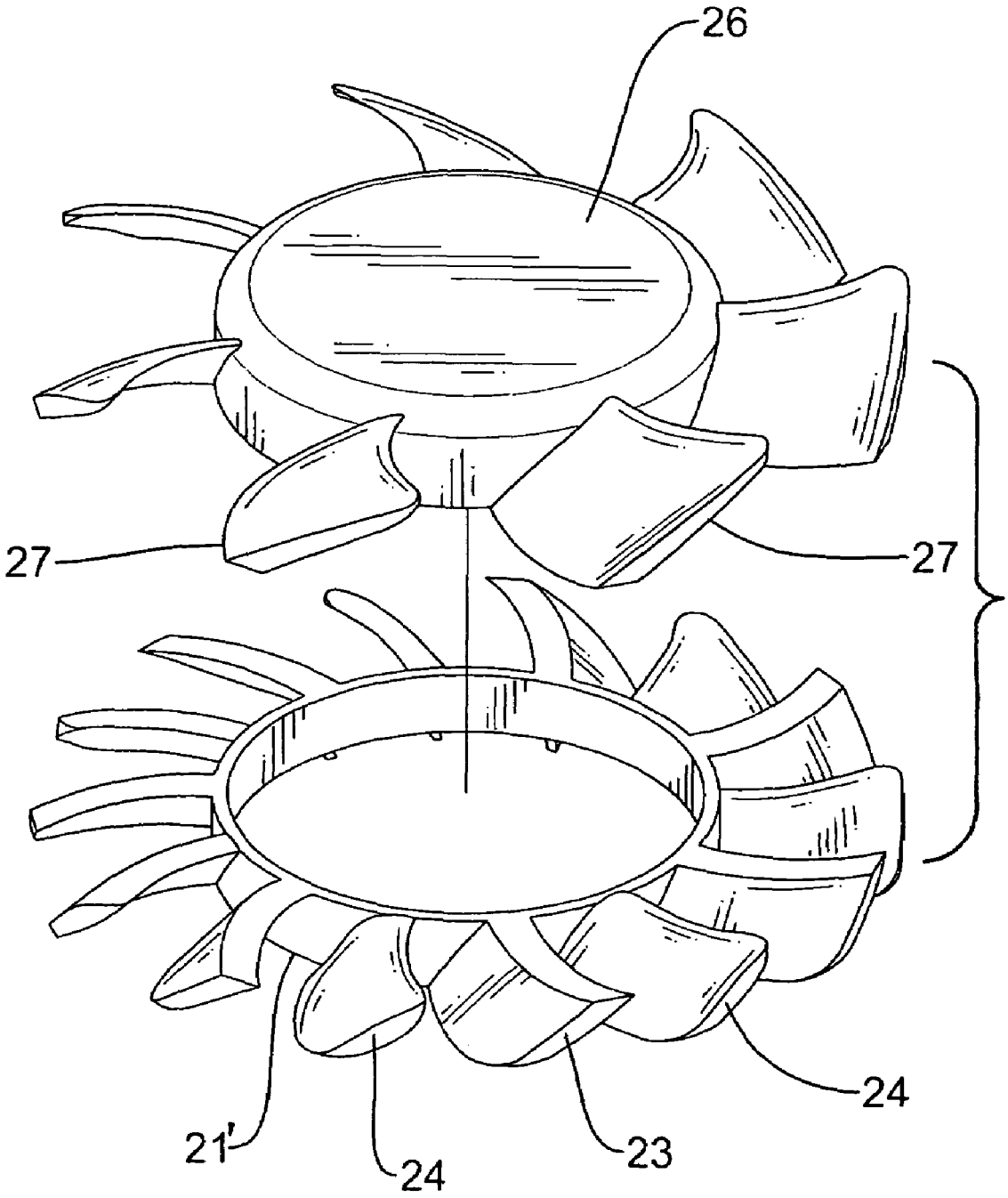
FIG. 4 is an exploded perspective view of a third embodiment of an impeller assembly in accordance with the present invention.

With reference to FIG. 4, the lower hub (21') is annular and has a diameter equal to that of the upper hub (26). In the third embodiment, the lower hub (21') is securely attached to the upper hub (26) with glue.

Figure 5:
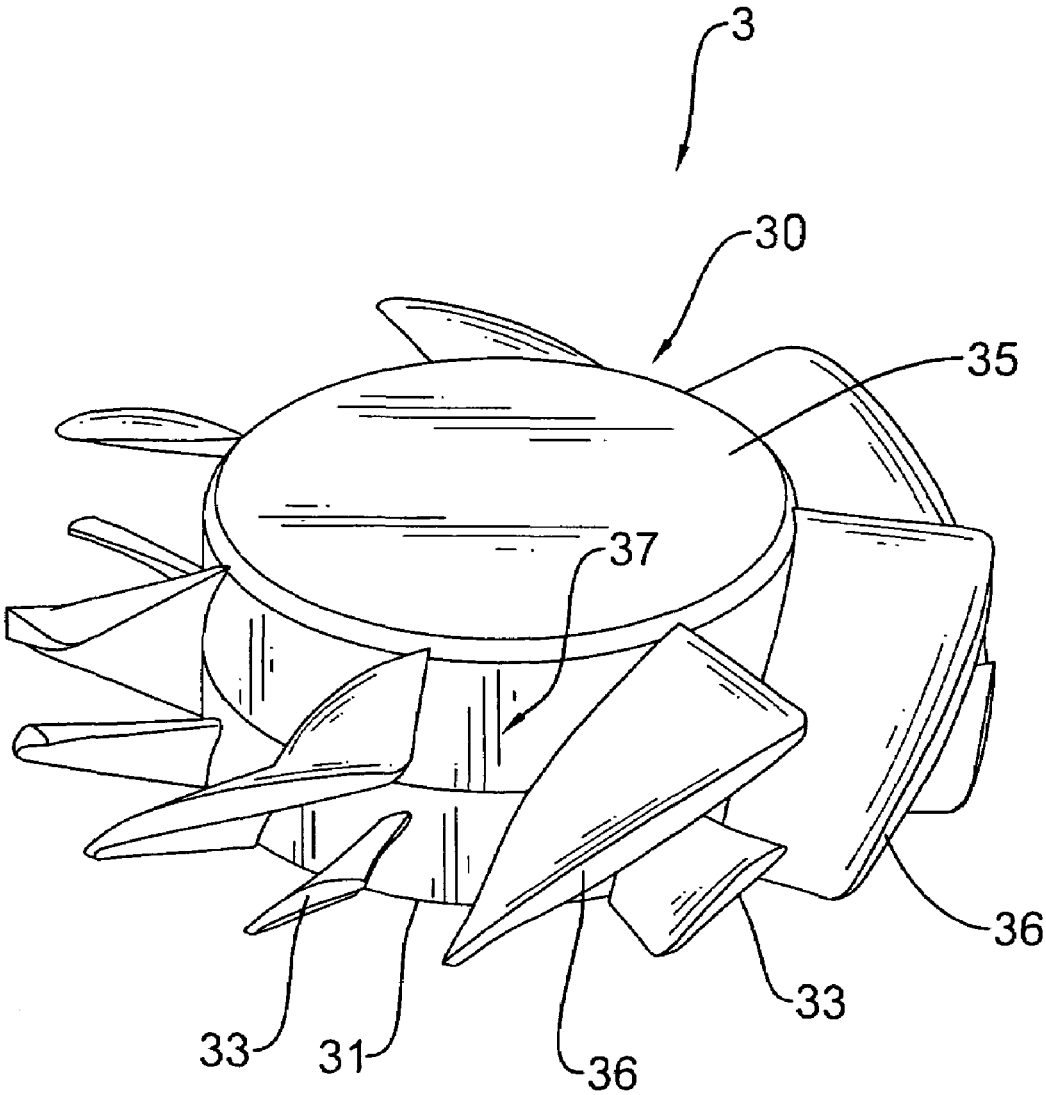
FIG. 5 is a perspective view of a fourth embodiment of an impeller assembly in accordance with the present invention.
Figure 6:
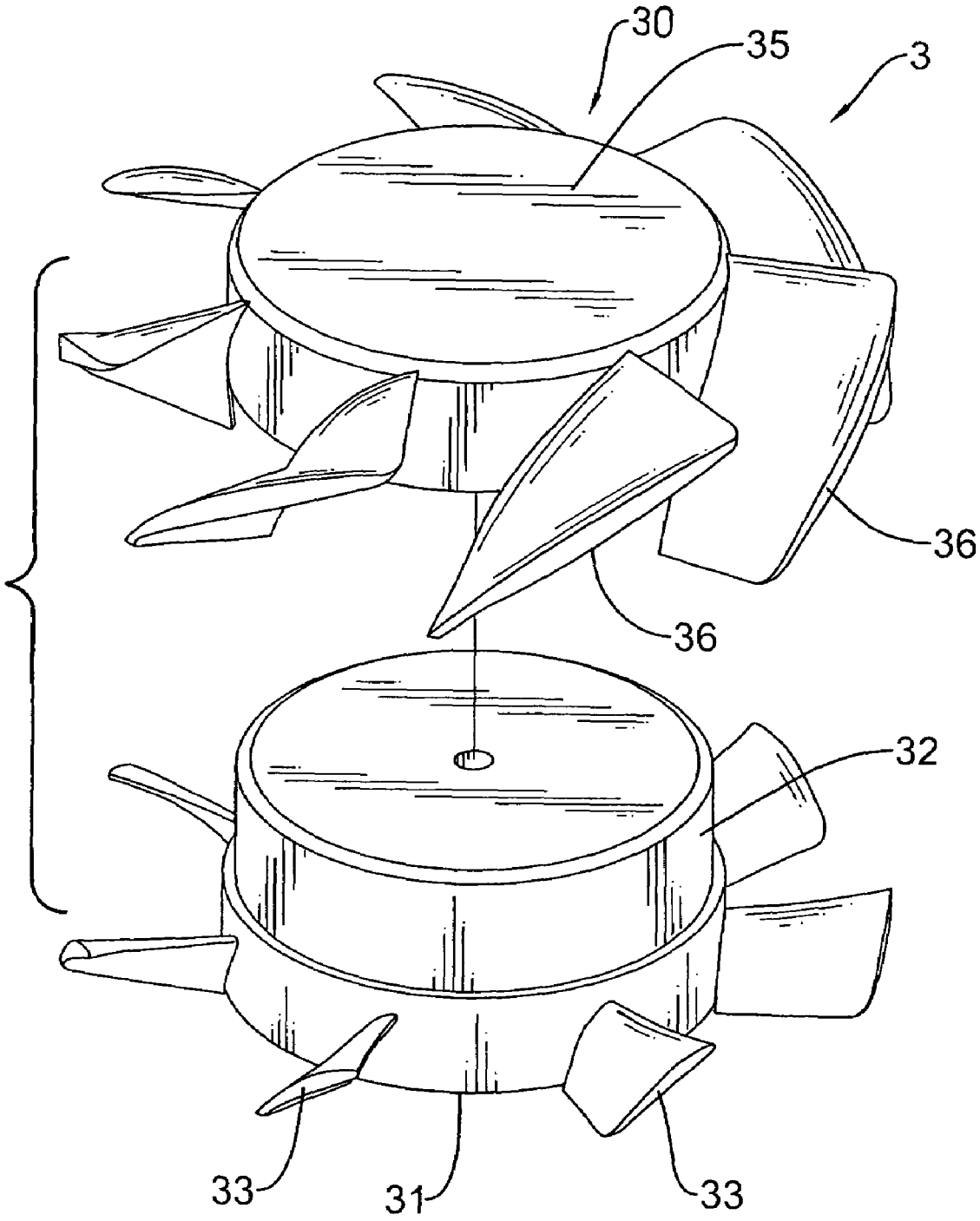
FIG. 6 is an exploded perspective view of the fourth embodiment of the impeller assembly in FIG. 5.
Figure 7:
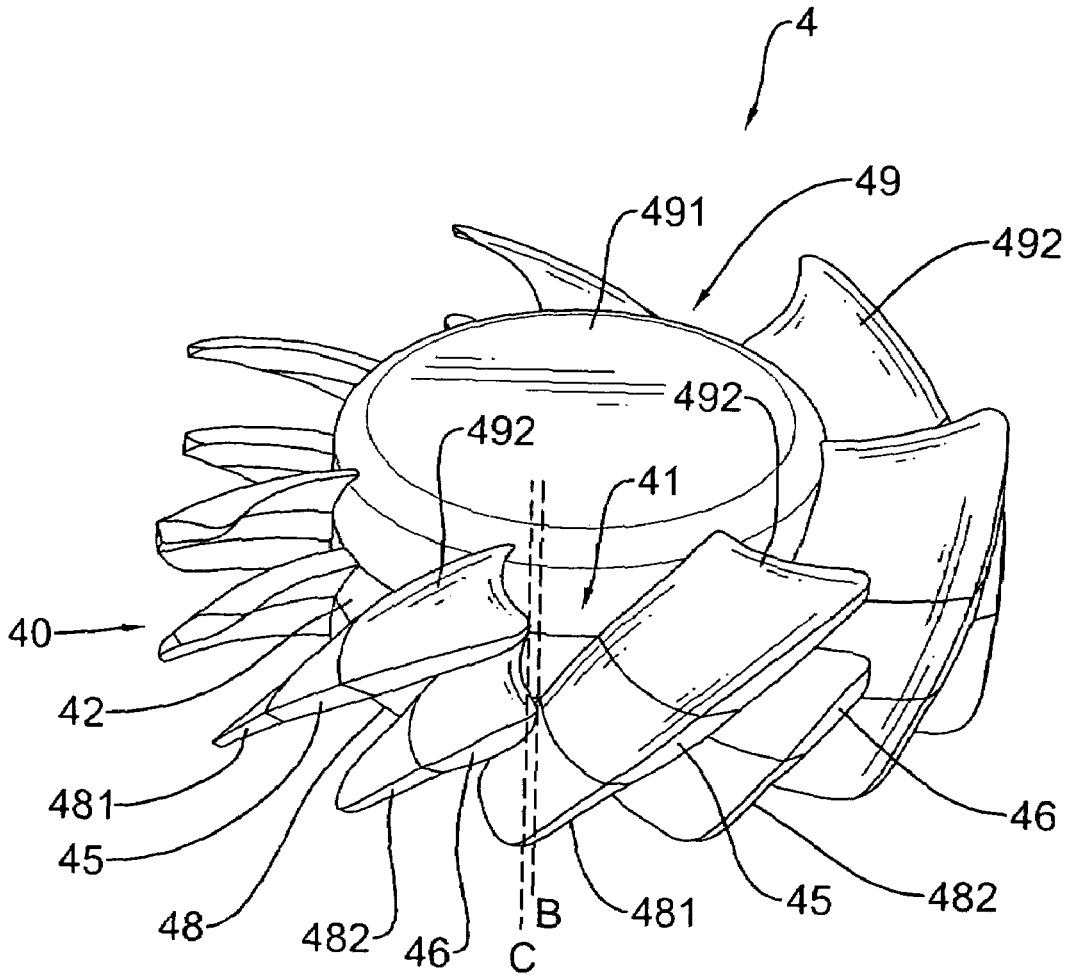
FIG. 7 is a perspective view of a fifth embodiment of an impeller assembly in accordance with the present invention.
Figure 8:
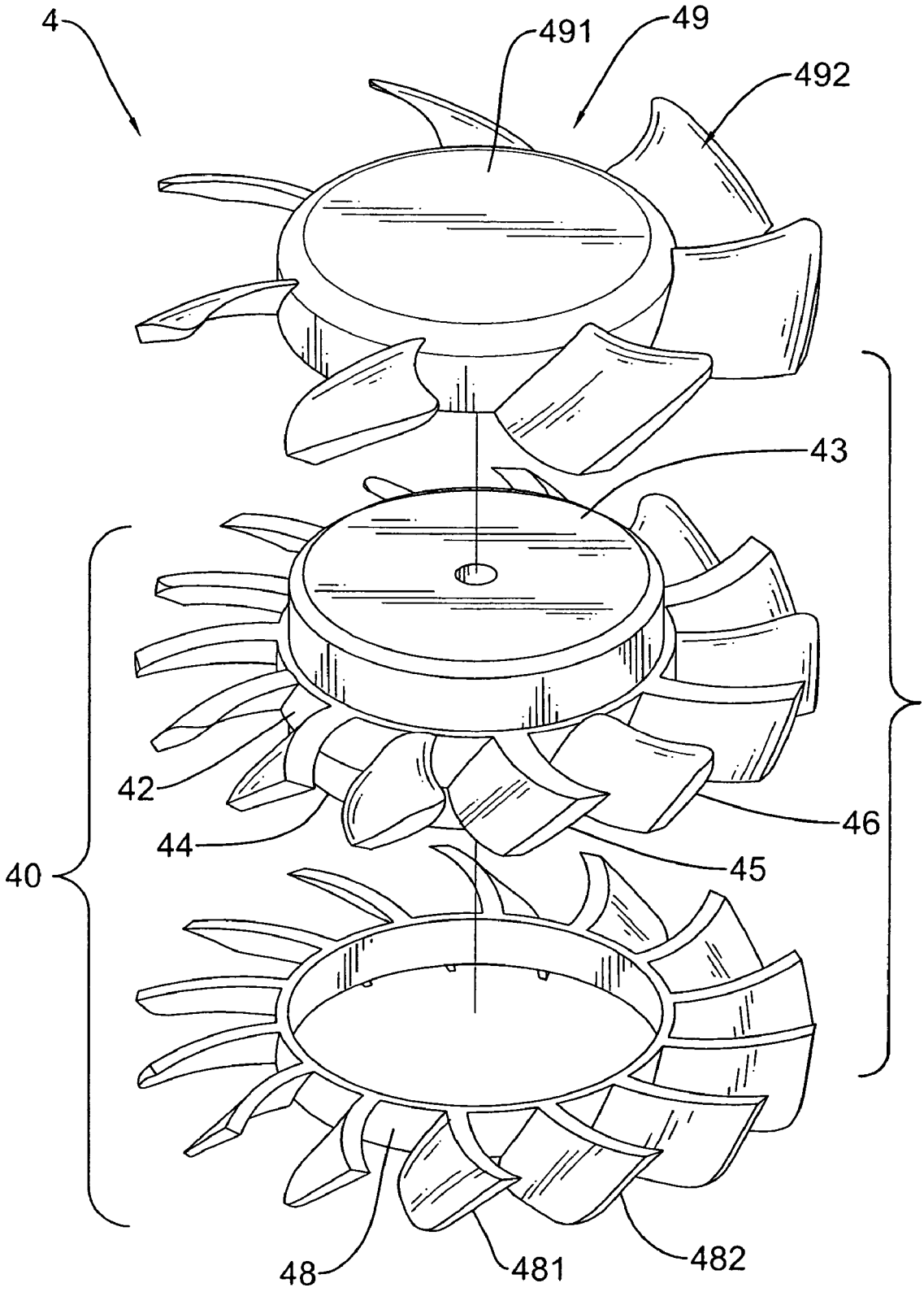
FIG. 8 is an exploded perspective view of the fifth embodiment of the impeller assembly in FIG. 7.

With reference to FIGS. 5 and 6, in a fourth embodiment, the body (30) of the impeller assembly (3) is composed of an upper hub (35) and a lower hub (31) attached to the upper hub (35). The lower hub (31) has a top and a protrusion (32) formed on the top. The upper hub (35) has a bottom cavity mounted around the protrusion (32) on the lower hub (31) to combine the upper hub (35) with the lower hub (31). The protrusion (32) has a diameter smaller than that of the lower hub (31), and the bottom cavity has a diameter equal to that of the protrusion (32) on the lower hub (31). Accordingly, the upper hub (35) is securely combined with the lower hub (31) with the engagement of the protrusion (32) and the bottom cavity. The main blades (36) are formed around the upper hub (35) and each has a bottom extending to the lower hub (31). Multiple flow channels (37) are defined between the main blades (36) and extend to the lower hub (31). The booster blades (33) are formed on the lower hub (31) and each is located between With reference to FIGS. 7 and 8, in a fifth embodiment of an impeller assembly (4), the body (491) of the impeller assembly (4) is composed of an upper hub (49) and a lower hub (40). The lower hub (40) is composed of a top body (42) and a bottom collar (48) attached to the top body (42). The top body (42) has a top, a bottom, a protrusion (43) formed on the top and an extension (44) formed on the bottom. The upper hub (49) has a bottom cavity mounted around the protrusion (43) on the top body (42) of the lower hub (40) to combine the upper hub (49) with the top body (42). The bottom collar (48) is securely mounted around the extension (44) on the top body (42). In a preferred embodiment, the protrusion (43) on the top body (42) has a diameter smaller than that of the top body (42). The bottom cavity has a diameter equal to that of the protrusion (43) on the top body (42). The extension (44) on the top body (42) has a diameter smaller than that of the top body (42). The bottom collar (48) has an inner diameter equal to that of the extension (44) on the top body (42).

The top body (42) and the bottom collar (48), respectively, have multiple half elements (45,481) to form the blade elements with the half elements (45,481) on the top body (42) and the bottom collar (48). Consequently, each main blade of the impeller assembly (4) is composed of one of the blade element (492) on the upper hub, a corresponding half element (45) on the top body and a corresponding half element (481) on the bottom collar (48), such that the length of the main blade is extended. Multiple flow channels (41) are defined between the combined main blades and are extended.

The top body (42) and the bottom collar (48), respectively, have multiple booster blade elements (46, 482) to form the booster blades with the booster blade elements (46, 482) on the top body (42) and the bottom collar (48). In the fifth embodiment, a line B extending upward from the top edge of a booster blade is not pointed to any part of the corresponding main blade, but a line C extending downward from the top edge of a corresponding main blade is pointed to a part of the booster blade. With such an arrangement, each booster blade partially overlaps the corresponding main blade.

Figure 9:
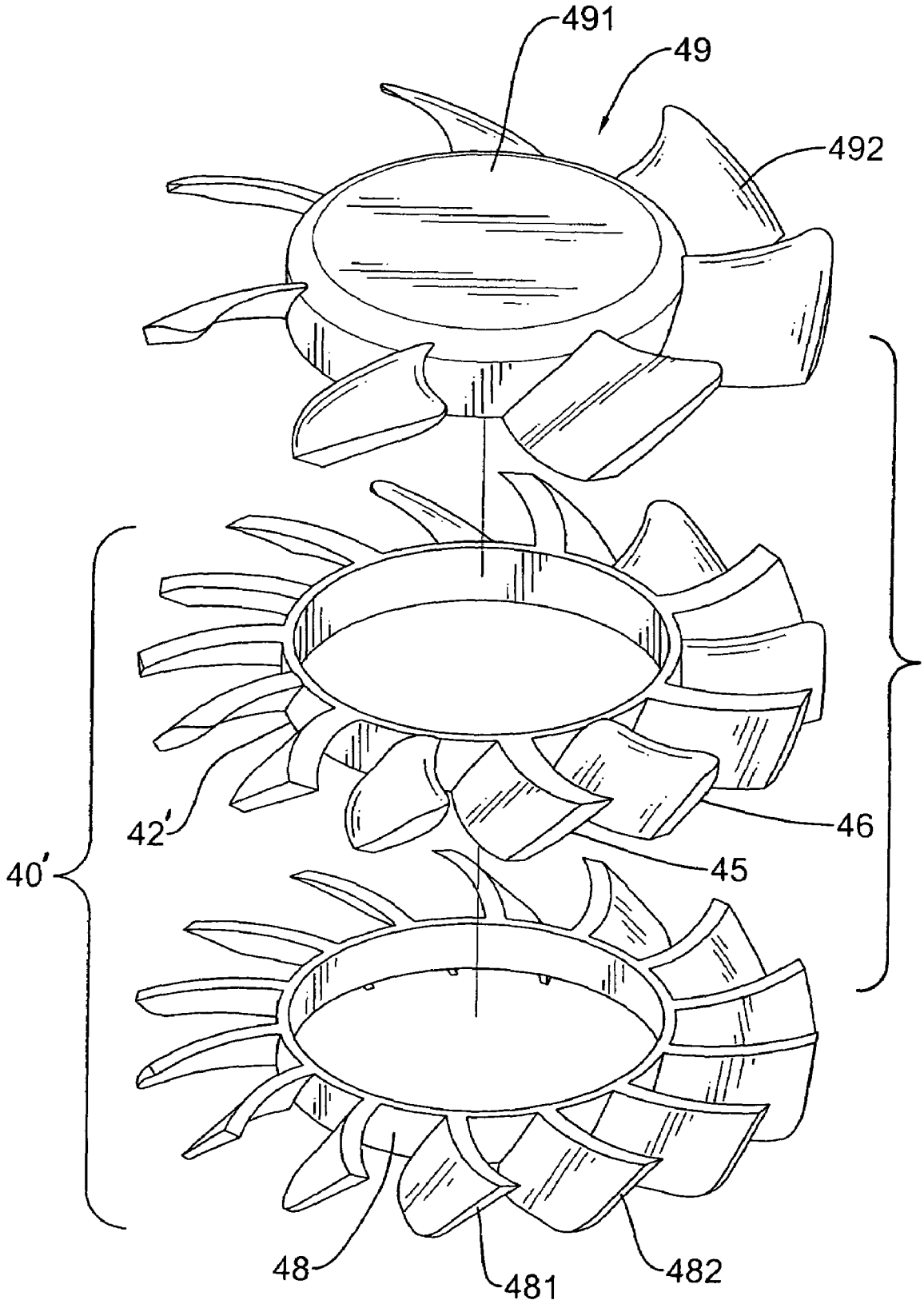
FIG. 9 is an exploded perspective view of a sixth embodiment of an impeller assembly in accordance with the present invention.
Figure 10:
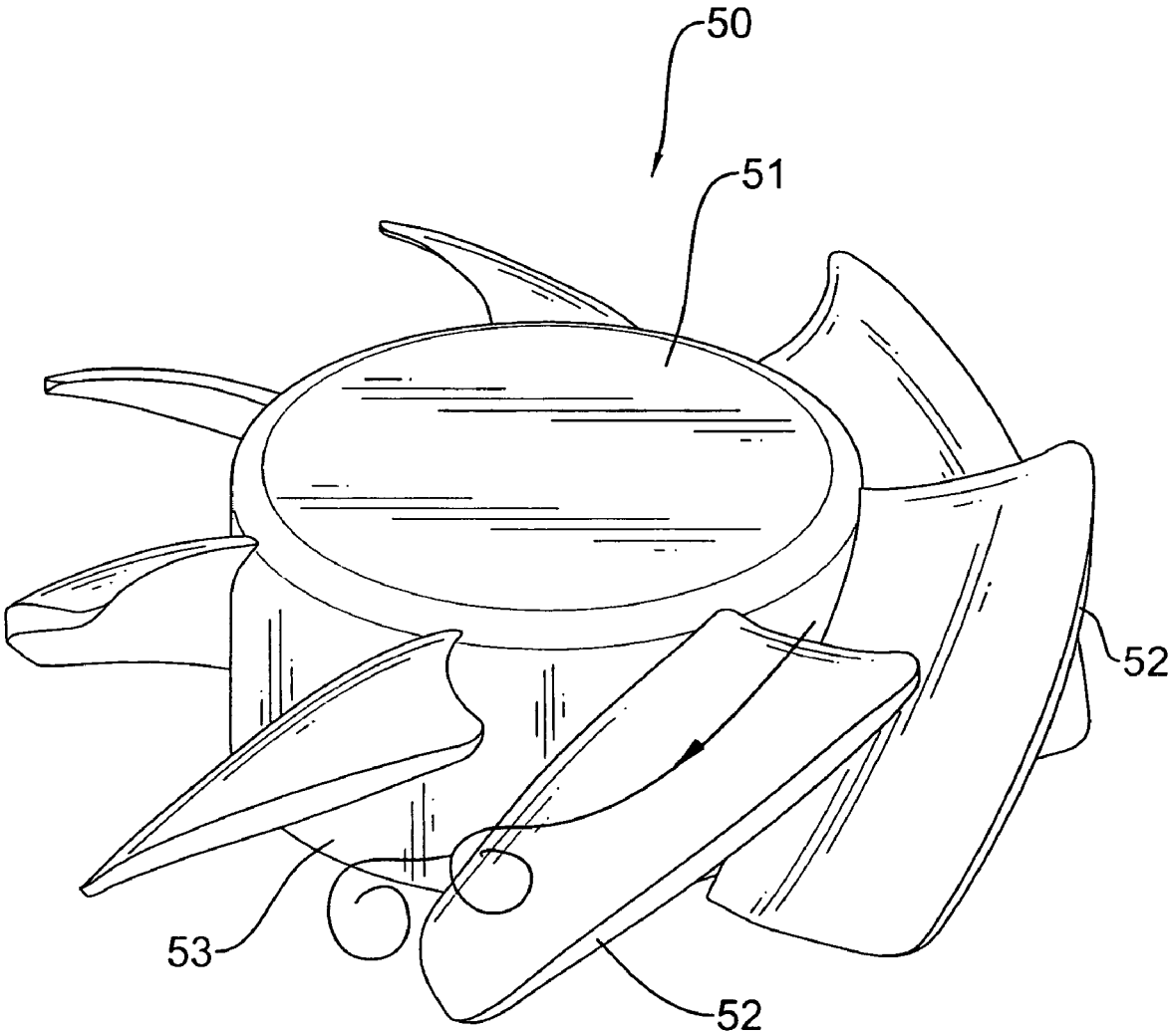
FIG.10 PRIOR ART
FIG. 10 is a perspective view of a conventional impeller assembly in accordance with the prior art.

With reference to FIG. 9, the top body (42') of the lower hub (40') is annular and has a diameter equal to that of the upper hub (49) and the bottom collar (48), and the top body (42') is securely attached to the upper hub (49) and the bottom collar (48) with glue.

With such an arrangement, the impeller assembly (1,2,3, 4) can provide advantages as follow:

1. With the arrangement of the booster blades (12,24,33), the outlets of the flow channels (13,28,37,41) will be divided into two parts and narrowed, and the speed of the air flowing out of the flow channels (13,28,37,41) is increased.

2. The booster blades (12,24,33) can provide an auxiliary attraction to the airflow in the flow channels (13,28,37,41) to make airflow smooth in the flow channels (13,28,37,41) and to keep air turbulence from generating in the flow channels (13,28,37,41).

3. The air exhausting from the outlets of the flow channels (13,28,37,41) can be prevented from flowing back to the flow channels (13,28,37,41) with the booster blades (12,24, 33). Consequently, the temperature of air in the flow channels (13,28,37,41) will not increase during the operation of the impeller assembly (1,2,3,4), such that the heat-dissipating efficiency of the impeller assembly (1,2,3,4) is improved.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An impeller assembly comprising:

a hollow body having a bottom edge;

multiple main blades mounted around the body to define multiple flow channels between the main blades; and multiple booster blades mounted around the body at the bottom edge and each located at a respective one of the flow channels to narrow an outlet of a corresponding flow channel, wherein each booster blade has a segment aligning with and axially overlapping with a corresponding one of the main blades.

2. The impeller assembly as claimed in claim 1, wherein the body is composed of an upper hub and a lower hub attached to the upper hub;

the upper hub and the lower hub respectively have multiple blade elements to form the main blades with the blade elements on the hubs; and the booster blades are formed on the lower hub and each is located between adjacent blade elements on the lower hub.

3. The impeller assembly as claimed in claim 2, wherein the lower hub has a top and a protrusion formed on the top; and the upper hub has a bottom cavity mounted around the protrusion on the lower hub to combine the upper hub with the lower hub.

4. The impeller assembly as claimed in claim 3, wherein the protrusion has a diameter smaller than that of the lower hub; and the bottom cavity has a diameter equal to that of the protrusion on the lower hub.

5. The impeller assembly as claimed in claim 2, wherein the lower hub is annular and has a diameter equal to that of the upper hub.

6. The impeller assembly as claimed in claim 1, wherein the body is composed of an upper hub and a lower hub attached to the upper hub;

the main blades are formed around the upper hub and each has a bottom extending to the lower hub; and the booster blades are formed on the lower hub and each is located between the bottoms of adjacent main blades on the upper hub.

7. An impeller assembly, comprising:

a hollow body having a bottom edge;

multiple main blades mounted around the body to define multiple flow channels between the main blades; and multiple booster blades mounted around the body at the bottom edge and each located at a respective one of the flow channels, wherein each booster blade has a segment aligning with and overlapping with a corresponding one of the main blades, wherein the body is composed of an upper hub and a lower hub attached to the upper hub;

the upper hub and the lower hub respectively have multiple blade elements to form the main blades with the blade elements on the hubs; and the booster blades are formed on the lower hub and each is located between adjacent blade elements on the lower hub, wherein the lower hub is composed of a top body and a bottom collar attached to the top body;

the top body and the bottom collar respectively have multiple half elements to form the blade elements with the half elements on the top body and the bottom collar; and the top body and the bottom collar respectively have multiple booster blade elements to form the booster blades with the booster blade elements on the top body and the bottom collar.

8. The impeller assembly as claimed in claim 7, wherein the top body has a top, a bottom, a protrusion formed on the top and an extension formed on the bottom; and the upper hub has a bottom cavity mounted around the protrusion on the top body of the lower hub to combine the upper hub with the top body of the lower hub; and the bottom collar is securely mounted around the extension on the top body.

9. The impeller assembly as claimed in claim 8, wherein the protrusion on the top body has a diameter smaller than that of the top body;

the bottom cavity has a diameter equal to that of the protrusion on the top body;

the extension on the top body has a diameter smaller than that of the top body; and the bottom collar has an inner diameter equal to that of the extension on the top body.

10. The impeller assembly as claimed in claim 7, wherein the top body of the lower hub is annular and has a diameter equal to that of the upper hub and the bottom collar.

* * * * *